United States Patent [19]

Horton

[11] Patent Number: 4,605,273

[45] Date of Patent: Aug. 12, 1986

[54] PARALLEL-BLADE/TWIST-LOCK ADAPTER PLUG

[76] Inventor: Paul D. Horton, 730 W. Washington Ave., Orange, Calif. 92668

[21] Appl. No.: 682,161

[22] Filed: Dec. 17, 1984

[51] Int. Cl.[4] ..... H01R 13/639

[52] U.S. Cl. ..... 339/75 P; 339/88 R; 339/156 R; 339/166 R

[58] Field of Search ..... 339/14 P, 88 R, 103 C, 339/107, 75 P, 154 A, 156 R, 157 R, 157 C, 158, 159 R, 159 C, 166 R

[56] References Cited

U.S. PATENT DOCUMENTS

| | | | |
|---|---|---|---|
| 2,100,094 | 11/1937 | Wahl | 173/344 |
| 2,436,217 | 2/1948 | Loctov | 173/343 |
| 2,464,893 | 3/1949 | Ross | 339/76 |
| 2,864,069 | 12/1958 | Bingham et al. | 339/75 |
| 2,994,849 | 8/1961 | Mussari, Jr. | 339/159 C |
| 3,242,455 | 3/1966 | Horvath et al. | 339/156 R |
| 3,439,308 | 4/1969 | Swartout | 339/154 A |
| 3,571,781 | 3/1971 | Gartland, Jr. et al. | 339/107 |
| 4,199,207 | 4/1980 | Lee | 339/75 P |
| 4,219,693 | 8/1980 | French | 339/82 |
| 4,241,969 | 12/1980 | D'Amato | 339/88 R |
| 4,494,809 | 1/1985 | Soloman | 339/154 A |

FOREIGN PATENT DOCUMENTS

| | | | |
|---|---|---|---|
| 942401 | 2/1974 | Canada | 339/103 C |
| 927515 | 5/1955 | Fed. Rep. of Germany | 339/14 P |
| 1640555 | 10/1970 | Fed. Rep. of Germany . | |
| 2125858 | 12/1972 | Fed. Rep. of Germany . | |
| 2345833 | 10/1977 | France . | |
| 82/00387 | 2/1982 | PCT Int'l Appl. . | |
| 1004526 | 9/1965 | United Kingdom . | |

*Primary Examiner*—John McQuade

*Attorney, Agent, or Firm*—William L. Chapin

[57] ABSTRACT

An adapter for insertion into a twist-lock receptacle has a cylindrical lower section with downwardly protruding male twist-lock blade terminals, a transverse mid plane with holes and female connectors disposed below the surface of the mid-plane adapted to receive male terminals from a parallel blade power plug, and a removable hollow semi-cylindrical shell section for retaining the power plug in its inserted position.

4 Claims, 5 Drawing Figures

PARALLEL-BLADE/TWIST-LOCK ADAPTER PLUG

BACKGROUND OF THE INVENTION

1. Field of the Invention

This invention relates to a device for facilitating the connection of power tools having a standard three-prong parallel blade terminal, grounded power plug to an electrical power source terminating in a three-prong twist lock receptacle. More particularly, the invention relates to adapters for use between twist-lock power receptacles and parallel blade power plugs.

2. Description of Background Art

On building construction sites, electrical power required to operate drills, saws and similar construction equipment is frequently available only at the terminals of a twist-lock receptacle. The twist-lock receptacle may be fixed to a portable generator panel or be attached to the end of a power cable.

In a standard twist-lock connector assembly, the receptacle, or female portion of the assembly, is provided with three arcuate, circularly arranged slots in the flat front face of the receptacle. The male portion of the connector assembly comprises a plug which has an equal number of arcuate blades extending perpendicularly outward from the front face of the plug. The dimensions and arrangement of the blades on the plug are complementary to the slots in the receptacle, in the sense that each blade can be inserted into a corresponding slot by simple axial movement of the plug body towards the receptacle body. Then the plug body is rotated with respect to the receptacle body. Now since one or more of the blades has a tab protruding back from the tip of the blade at an angle to the plane of the blade, and the corresponding slot has a laterally extending recess adapted to receive the tab, rotation of plug and receptacle body with respect to one another causes the tab to engage the recess. In this position, receptacle and plug are locked together, and may be disengaged only by rotating plug and receptacle relative to one another in an opposite, disengaging tab and recess and permitting plug and receptacle to be pulled apart from one another.

Twist-lock plugs and receptacles of the type described are used at construction sites to prevent accidental disconnection of plug and receptacle solely by applying a tug on either receptacle or plug cord. In fact, safety regulations frequently mandate the use of twist-lock connectors in hazardous environments, to guard against the production of sparks, or the possible contact of live receptacle terminals with water which might be on the surface over which the power cord is strung.

While many construction sites have electrical power available only at twist-lock receptacles for the reasons described above, most standard power tools are supplied with an integral power cord having a standard three-prong grounded plug. In plan view, the three-prong grounded plug has two parallel, rectangular cross section blades providing source and return terminal functions, and a circular cross-section earth ground terminal located on the mid plane between the two blades, but displaced perpendicularly from a perpendicular line joining the inner parallel faces of the blades.

The standard grounded three-prong power plug used with most power tools cannot be plugged into a twist-lock receptacle. Therefore, if a construction worker wishes to use a standard power tool at a construction site, he must presently cut off the plug from the tool power cord and reconnect the power cord to a twist-lock power plug. This is generally a time consuming and therefore costly process. Furthermore, removing the standard three-prong, grounded plug and replacing it with a twist-lock plug makes the power tool unusable at other locations which do not have twist-lock receptacles available.

OBJECTS OF THE INVENTION

An object of the present invention is to provide an adapter permitting electrical appliances provided with a standard, parallel blade grounding plug and cord to receive electrical power from a three-prong, twist-lock power receptacle.

Another object of the invention is to provide an adapter which may be removably attached to a parallel blade plug and inserted into a twist-lock receptacle.

Another object of the invention is to provide an adapter which may be quickly and easily fastened to a parallel blade power plug, permitting the electrical appliance connected to the power plug to receive power from a twist-lock receptacle.

Various other objects of the present invention, and its most novel features, will become apparent to those skilled in the art by reading the accompanying specification and claims.

It is to be understood that although the invention disclosed herein is fully capable of achieving the objects and providing the advantages described, the characteristics of the invention described herein are merely illustrative of the preferred embodiment. Accordingly, I do not intend the scope of my exclusive rights and privileges in the invention to be limited to the details of the embodiment described. I do intend that reasonable equivalents, adaptations and modifications of the invention described herein be included within the scope of this invention as defined by the appended claims.

SUMMARY OF THE INVENTION

Briefly stated, the present invention comprehends an adapter for receiving a parallel blade electrical power plug and plugging into a twist-lock power receptacle. The adapter according to the present invention includes means for insertably receiving the protruding terminals of a parallel blade power plug including a cylindrical grounding terminal. The adapter also has protruding arcuate, circularly arranged blades adapted to fit into a standard twist-lock power receptacle. Means are provided within the adapter to conduct electrical current from each twist-lock blade terminal to a corresponding terminal on the parallel blade plug. Means are also provided to clamp the adapter securely to the power cord terminated by the parallel blade plug.

DESCRIPTION OF THE PREFERRED EMBODIMENT

Figure 1:
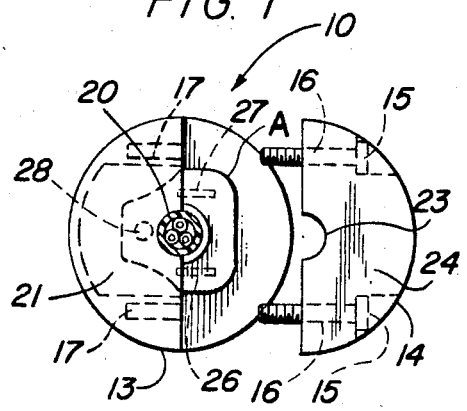
FIG. 1 is an exploded top plan view of the adapter according to the present invention.
Figure 2:
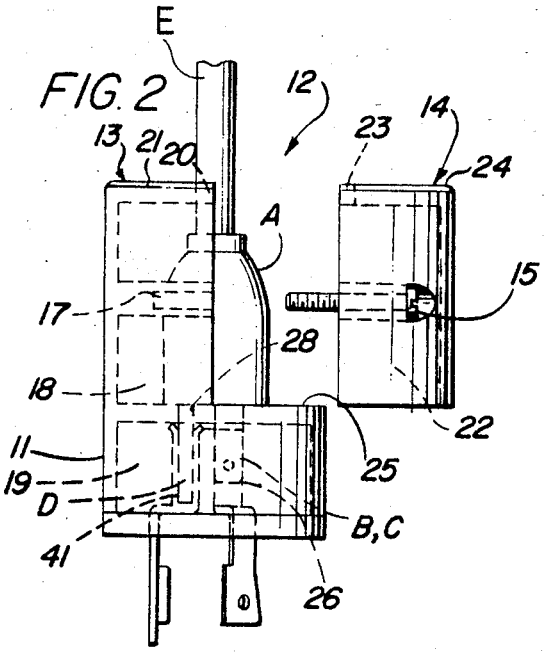
FIG. 2 is an exploded front elevation view of the article of FIG. 1 showing a power plug installed therein.
Figure 5:
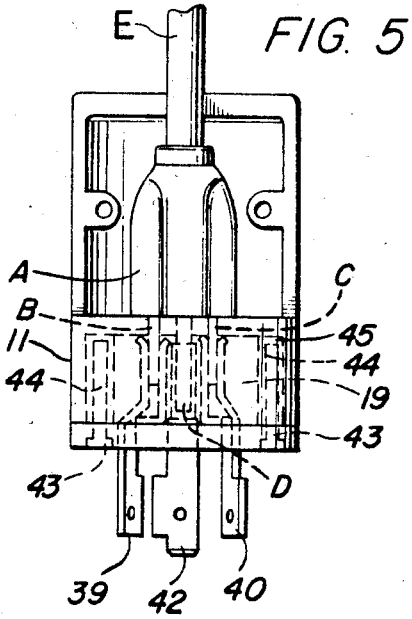
FIG. 5 is a side elevation view of the article of FIG. 1 showing a power plug installed therein.
Figure 3:
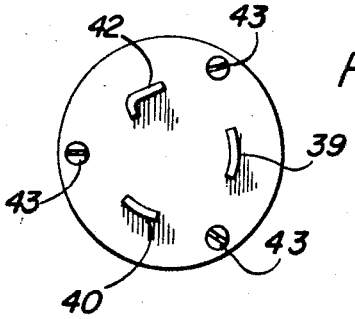
FIG. 3 is a bottom plan view of the article of FIG. 1.

Referring now to FIGS. 1 through 3, the basic embodiment of the parallel-blade to twist-lock adapter plug 10 according to the present invention is shown. As shown in the Figures, the base portion 11 of adapter plug 10 has the general appearance of a solid cylindrical body. The upper portion 12 of adapter plug 10 comprises a generally semi-cylindrical upper half section 13 integral with the base portion 11 of the adapter plug, and a removable semi-cylindrical clamping element 14.

Base portion 11, upper half section 13 and removable clamping element 14 are all fabricated from a durable material which is a good electrical insulator. Many thermosetting plastics are suitable for this application.

Section 13 and removable clamping element 14 are fastenable together by means of screws 15 extending laterally inward through holes 16 which extend through the outer cylindrical face of the clamping element and also through its flat, vertical inner face. Matching blind, threaded holes 17 are provided in the inner flat vertical face of upper half section 13 of adapter plug 10.

As may be seen best by referring to FIG. 2, the interior of upper half section 13 of adapter plug 10 contains a generally semi-cylindrically shaped cavity 18. A semi-cylindrical hole 20 extends through the top face 21 of upper half section 13 into cavity 18.

Similarly, removable clamping element 14 contains a semi-cylindrical cavity 22 which is the mirror image of cavity 18. A semi-cylindrical hole 23 extends through the top face 24 of clamping element 14.

As may be seen best by referring to FIG. 2, with clamping element 14 separated laterally from upper half section 13, the flat upper surface 25 of base portion 11 of adapter plug 10 is exposed. As shown in FIGS. 1 and 2, upper surface 25 of base portion 11 has a front rectangular hole 26, a rear rectangular hole 27 disposed parallel to hole 26, and a side cylindrical hole 28 adapted to receive parallel current conducting terminal blades B and C and cylindrical ground terminal D respectively, of a parallel blade, three-prong power plug A. Extending longitudinally downward beneath each hole in upper surface 25 of base portion 11 is an elastically deformable female connector adapted to insertably receive a corresponding protruding terminal of parallel-blade, three-prong power plug A.

Figure 4:
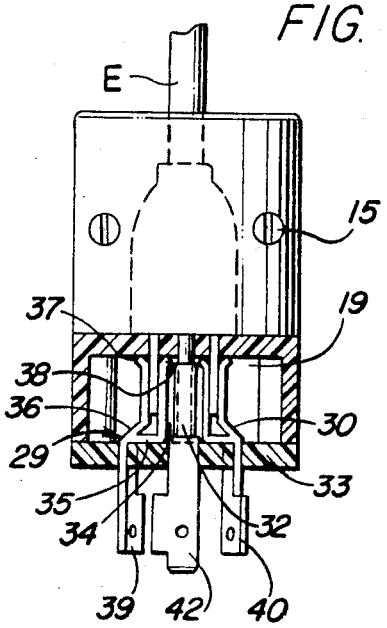
FIG. 4 is a partially sectional side elevation view of the article of FIG. 1.

As may be seen best by referring to FIG. 4, the parallel blade terminals B and C of power plug A are engageable by identical connectors 29 and 30 disposed longitudinally downward from holes 26 and 27 respectively, through upper surface 25 of base portion 11 of adapter plug 10. Connectors 29 and 30 are fabricated from strips of metal having good electrical conductivity and sufficiently good elastic memory to function as springs. Phosphor bronze or tempered copper are suitable materials for this application.

As shown in FIG. 4, metal strips from which connectors 29 and 30 are fabricated are fastened to an elongated support post 32 centrally mounted on base disc 33, which closes cylindrical cavity 19 in base portion 11 of the adapter plug. Base disc 33 is fastened to base portion 11 of the adapter plug by means of screws 43 extending upward from the bottom face of the base disc. Screws 43 are tightened into threaded holes 44 in longitudinally disposed ribs 45 spaced equally on the interior circumference of cavity 19 of base portion 11. Support post 32 is fabricated from a durable insulating material and may be an integral part of base disc 33. The metal strips from which connectors 29 and 30 are fabricated are formed into a generally U-shaped structure with a first, inner leg 34 of the U fastened conformally to a vertical side wall of support post 32. The base 35 of the U-shaped structure is fastened conformally to the upper surface of base disc 33, and the second, outer leg 36 of the U is bent inwards to contact the first leg. The upper end 37 of the metal strip comprising second leg 36 is bent outward. Upper end 38 of inner leg 34 of the strip and upper end 37 of outer leg 36 are both positioned in a common transverse plane slightly below the common plane of hole 26 and 27. When blade terminal B or C is inserted into hole 26 or 27, legs 34 and 36 of connector 29 are forced apart. The elasticity of the metal strip keeps legs 34 and 36 in tight contact with the parallel faces of blade terminal B or C, providing at once a good electrical connection between the blade terminal and the connector, and a strong compressive force resisting withdrawal of a blade terminal from the connector.

Base portion 35 of connector 29 is connected conductively to a first arcuate twist-lock terminal blade 39 which is fastened to base disc 33 and extends perpendicularly outward therefrom. Connector 29 and terminal blade 39 are preferably joined by a rivet or screw. Alternatively, connector 29 and terminal blade 39 may be joined by welding or brazing. Base portion 35 of connector 30 is similarly connected to a second arcuate twist-lock terminal blade 40 which is also fastened to base disc 33 and extends perpendicularly outward therefrom.

Cylindrical ground terminal D of power plug A is engageable by a female connector 41 disposed longitudinally below hole 28 in upper surface 25 of base portion 11 of the adapter plug. Connector 41 is similar in instruction to connectors 29 and 30, and is connected electrically to a third, grounding twist-lock terminal blade 42 fastened to base disc 33 and extending perpendicularly downward therefrom.

To use adapter plug 10, clamping element 14 is removed from the plug by unscrewing screws 16. Parallel blade plug A is then moved axially toward the upper surface 25 of base portion 11 of adapter plug 10. Parallel blade terminals B and C, and cylindrical ground terminal D of plug A are then simultaneously inserted into holes 26, 27 and 28, respectively through surface 25. Plug A and adapter plug 10 are then squeezed together, engaging male terminals of plug A with corresponding female connectors of adapter plug 10. Clamping element 14 is then replaced on adapter plug 10, and screws 16 are tightened sufficiently to force the inner surface of semi-cylindrical hole 20 in upper half of section 13 of the adapter plug, onto one side of cord E attached to plug A, and the inner surface of semi-cylindrical hole 23 in clamping element 14 onto the opposite side of the cord. With cord E thus restrained by the opposing compressive forces applied to the circumferential holes of the cord by upper half section 13 and clamping element 14 of adapter plug 10, plug A cannot be accidentally pulled out of engagement with adapter plug 10. Therefore, when arcuate twist-lock blade terminals 39, 40 and 42 extending perpendicularly downward from the base of adapter plug 10 are inserted and rotated into a mating female twist-lock receptacle, the power cord E cannot be accidentally disengaged from its power source by pulling on the power cord.

With the adapter plug according to the present invention used as described, a convenient and quick means for connecting power tools having a parallel blade power plug to a twist-lock receptacle is provided. Furthermore, the adapter plug according to the present invention prevents accidental disengagement of power plug and power source.

What is claimed is:

1. An adapter plug adapted to provide electrical connections between corresponding terminals of a parallel blade male connector plug and a female twist-lock connector having arcuate, circularly arranged connector slots, said adapter plug comprising:

a. an elongated cylindrical base having parallel, transversely disposed upper and lower faces, b. a plurality of female connectors adapted to insertably receive male connector terminals from said parallel blade male connector plug, said female connectors being disposed axially downward from said upper face of said base, c. a plurality of arcuate, circularly arranged twist-lock connector blades extending axially downward from said lower face of said base, d. a plurality of electrical conductors separately connecting each said female connector to a separate twist-lock connector blade, and e. means for loosenably clamping said parallel blade male connector plug to said adapter plug base, said clamping means comprising:

(i) a fixed, hollow semi-cylindrical extension continuous with a semi-cylindrical face of said base and extending longitudinally upward from the plane of said upper transverse face of said base, (ii) a removable hollow semi-cylindrical section continuous with the opposite semi-cylindrical face of said base and extending longitudinally upward from the plane of said upper transverse face of said base, and (iii) means for removably fastening said fixed hollow semi-cylindrical extension and said removable hollow semi-cylindrical section together.

2. The article of claim 1 wherein said fixed semi-cylindrical extension and said removable hollow semi-cylindrical section each has a transversely disposed upper face and a centrally located semi-cylindrical cross-section hole disposed longitudinally downward through said upper face, thereby providing, when said removable semi-cylindrical section is fastened to said base, a circular cross-section, longitudinally disposed hole through the upper transverse faces of said fixed semi-cylindrical extension and said removable hollow semi-cylindrical section into the hollow interiors of said extension and said section.

3. The article of claim 2 wherein said means for removably fastening said removable semi-cylindrical section to said fixed semi-cylindrical extension comprises at least one screw transversely disposed through transverse colinear holes in said section and said extension.

4. An adapter plug for providing electrical connections between corresponding terminals of a parallel blade male connector plug and a female twist-lock connector having accurate, circularly arranged connector slots, said adapter plug comprising:

(a) an elongated cylindrical insulating body having upper and lower transverse faces disposed perpendicularly to the cylindrical axis of said body, said body having a base section and a hollow upper section joined to said base section at a transverse joint plane, said hollow upper section having a cylindrical cavity coaxial with said body, said hollow upper section comprising a fixed semi-cylindrical section fastened to said base and a removable semi-cylindrical section, and said hollow upper section having a longitudinally disposed hole coaxial with the cylindrical axis of said body through said upper transverse face of said body, said hole communicating with the hollow interior of said hollow upper section, (b) means for removably fastening said removable semi-cylindrical section to said fixed semi-cylindrical section, (c) a plurality of female connectors disposed longitudinally downward from the upper surface of said transverse joint plane, said female connectors being adapted to insertably receive male terminals from said parallel blade male connector plug, (d) a plurality of arcuate, circularly arranged, elongated male twist-lock connector blades secured to the lower transverse face of said insulating body and extending perpendicularly outward therefrom, and (e) a plurality of electrical conductors separately connecting each said female connector to a selected one of said twist-lock connector blades.

* * * * *